US008689505B2

(12) United States Patent
Cousin

(10) Patent No.: US 8,689,505 B2
(45) Date of Patent: Apr. 8, 2014

(54) PROFILE-BENDING MEANS FOR FRAME TO BE POCKETED

(75) Inventor: Etienne Cousin, Haubourdin (FR)

(73) Assignee: Newmat, Haubourdin (FR)

( * ) Notice: Subject to any disclaimer, the term of this patent is extended or adjusted under 35 U.S.C. 154(b) by 0 days.

(21) Appl. No.: 13/055,383

(22) PCT Filed: Jul. 21, 2009

(86) PCT No.: PCT/FR2009/000894

§ 371 (c)(1),
(2), (4) Date: Apr. 22, 2011

(87) PCT Pub. No.: WO2010/010249

PCT Pub. Date: Jan. 28, 2010

(65) Prior Publication Data

US 2011/0203210 A1 Aug. 25, 2011

(30) Foreign Application Priority Data

Jul. 22, 2008 (FR) ..... 08 04176

(51) Int. Cl.

| | |
|---|---|
| ***E04B 9/24*** | (2006.01) |
| ***E04B 9/30*** | (2006.01) |
| ***E04B 9/04*** | (2006.01) |

(52) U.S. Cl.

USPC ..... 52/222; 52/223.14; 52/291; 52/506.07

(58) Field of Classification Search

USPC ..... 52/222, 223.6, 223.14, 291, 506.07, 52/656.1, 800.1, 801.1, 801.11, 836, 843, 52/845, 514, 712, 717.06, 573.1

See application file for complete search history.

(56) References Cited

U.S. PATENT DOCUMENTS

| | | | | |
|---|---|---|---|---|
| 2,092,411 | A * | 9/1937 | Anderson | 52/223.6 |
| 2,109,659 | A * | 3/1938 | Adamson | 52/745.15 |
| 2,856,646 | A * | 10/1958 | Latimer et al. | 52/223.6 |
| 4,324,079 | A * | 4/1982 | Pearson | 52/255 |
| 5,640,808 | A * | 6/1997 | Simeone et al. | 49/504 |
| 5,664,392 | A * | 9/1997 | Mucha | 52/715 |
| 5,918,660 | A * | 7/1999 | Crawford et al. | 160/201 |
| 7,685,786 | B2 * | 3/2010 | Cousin | 52/506.06 |
| 7,770,349 | B2 * | 8/2010 | Tedesco et al. | 52/506.08 |
| 8,132,832 | B2 * | 3/2012 | Anderson | 292/340 |
| 2005/0139334 | A1 | 6/2005 | Bernardi | |
| 2007/0157535 | A1 | 7/2007 | Cousin | |

FOREIGN PATENT DOCUMENTS

| | | | |
|---|---|---|---|
| DE | 43 34 957 | * | 11/1994 |
| FR | 2 712 325 | A1 | 5/1995 |
| FR | 2 751 682 | A1 | 1/1998 |
| FR | 2 789 101 | A1 | 8/2000 |
| FR | 2 793 504 | A1 | 11/2000 |
| FR | 2 793 506 | A1 | 11/2000 |
| FR | 2 814 482 | A1 | 3/2002 |
| JP | 11-141216 | * | 5/1990 |
| WO | 99/50512 | A1 | 10/1999 |
| WO | 2007/051927 | A1 | 5/2007 |

* cited by examiner

*Primary Examiner* — Robert Canfield
(74) *Attorney, Agent, or Firm* — Sughrue Mion, PLLC

(57) ABSTRACT

A panel frame for suspended ceiling, at least one side of this frame having, when seen in section, a top wall and a side wall. The top wall is provided with a fitted flat section, this flat section having at least two through-holes for the passage of an assembly mechanism such as screws, one of the through-holes being ovalized or oblong.

11 Claims, 2 Drawing Sheets

PROFILE-BENDING MEANS FOR FRAME TO BE POCKETED

CROSS REFERENCE TO RELATED APPLICATIONS

This application is a National Stage of International Application No. PCT/FR2009/000894, filed on Jul. 21, 2009, which claims priority from French Patent Application No. 08/04176, filed on Jul. 22, 2008, the contents of all of which are incorporated herein by reference in their entirety.

The invention relates to the technical field of suspended ceilings and false walls.

The invention relates more particularly to the panels of suspended ceilings or false walls comprising a stretched sheet and a frame.

Already known in the prior art are various designs of such panels for suspended ceilings.

According to the conventional technology, the sheet is made of polyvinyl chloride and is first of all placed under tension before being fixed to a frame, this frame itself being previously obtained by the assembly of aluminium section pieces.

One considerable difficulty in the production of these panels is that the frame deforms following the fixing under tension of the sheet on this frame.

Various solutions have been proposed in the prior art to solve this problem.

A proposal has been made to provide means applying a prestress directed from the inside to the outside of the frame. It is possible to refer, for example, to document FR 2 712 325 of the applicant, or to documents FR 2 751 682, FR 2 814 482.

Frame section pieces provided with reinforcing flanges have also been proposed. It is possible to refer in particular to documents FR 2 793 504, FR 2 793 506, FR 2 789 101. These three prior documents, originating from the same filing company Scherrer, and arising from the same technical problem, describe three contradictory and opposed embodiments.

In a first embodiment, described by document FR 2 793 504, the aluminium section-piece element comprises two flanges, namely one vertical outer flange to which the polyvinyl chloride sheet is fixed, and a vertical inner flange the base of which is set back from the base of the outer flange so as not to come into contact with the sheet.

In a second embodiment, described by document FR 2 793 506, the aluminium section-piece element comprises two flanges, namely a vertical outer flange to which the polyvinyl chloride sheet is fixed, and an inclined or vertical inner flange the base of which is situated beneath the base of the outer flange so as to come into contact with the sheet.

In a third embodiment, described by document FR 2 789 101, the aluminium section-piece element comprises a horizontal top wall, a vertical side wall and an oblique stiffening wall, the section piece forming a box assembly.

In each of the three assemblies described by documents FR 2 793 504, FR 2 793 506, FR 2 789 101, the sheet is fixed to the transverse edge of one flange of the section piece, in particular by bonding, and this fixing edge is shown to be very narrow. No numerical value is given, even as an example, for this width of the sheet fixing edge.

The purported advantage of this "narrowness" of the fixing strip is as follows: when the panel is placed on a bearing element in the shape of an inverted T fixed to a ceiling by tie rods, the zone for bonding the sheet to the frame is completely hidden from the eyes of an observer looking at the suspended ceiling, since the width of the transverse strip of the T-shaped section piece is greater than the width of the zone for bonding the sheet to its frame.

The panels described in documents FR 2 793 504, FR 2 793 506 or FR 2 789 101 have many drawbacks.

First, when the panels are of large surface area, for example of the order of a square meter, a great tension of the sheet can always cause a deformation of the frame to which the sheet is bonded.

Secondly, the T-shaped elements supporting the panels should preferably be as discreet as possible, the width of their transverse branch having to be as narrow as possible so that the suspended ceiling has an appearance as close as possible to that of a real ceiling. The assemblies described in documents FR 2 793 504, FR 2 793 506 or FR 2 789 101 do not make it possible to significantly reduce the width of the T-shaped supporting elements, in particular when the panels have a large surface area, without the zone for bonding the sheet being apparent. The greater the surface area of the panel, the wider the zone for bonding the sheet to the frame must be, this bonding zone no longer being able to be masked by the T-shaped support, without increasing the width of this T-shaped section piece.

The panel described in document FR 2 793 506 has the following additional drawback: the sheet of each panel is not stretched flat in its frame since the finishing of the suspended ceiling cannot be similar to that of a conventional flat ceiling.

Reference may also be made to document WO 9950512.

To solve the problems mentioned above, the applicant has developed a profile for a frame to be pocketed, this profile being described notably in document WO 2007051927.

The applicant has however found that even by using section pieces as described in document WO 2007051927, a very slight appearance defect remained possible, in particular when the panels have a large surface area.

The applicant has attempted to solve this problem in a simple, rapid and low-cost manner, and without modifying the structure of the panel frame or the method for pocketing it.

For this purpose, according to a first aspect, the invention relates to a panel frame for a suspended ceiling, at least one side of this frame comprising, when seen in section, a top wall and a side wall, the top wall being provided with a fitted flat section, this flat section comprising at least two through-holes for the passage of assembly means such as screws, one of the through-holes being ovalized or oblong.

In various embodiments, the frame has the following features, optionally combined:

- the frame having a substantially rectangular, square or polygonal contour, it comprises at least two flat sections placed substantially parallel to one of the sides of the frame contour;
- the width of the flat section is substantially less than the width of the top wall;
- each flat section is provided with three substantially aligned through-holes, one of the through-holes being ovalized or oblong;
- the ovalized or oblong through-hole is placed laterally or substantially half way along the flat section;
- the side wall comprises a substantially vertical top portion and a bottom portion, the bottom portion and top portion defining an obtuse angle, on the outer face of the panel frame;
- at least one frame side comprises, when seen in section, in addition to the said top wall and side wall, at least one stiffening wall;

the frame comprises a first stiffening wall, this first stiffening wall forming a box assembly with the top wall, the side wall and an inner flange;

the frame comprises a second stiffening wall, this second wall forming a box assembly with the first stiffening wall and the side wall;

the said frame side comprises, when seen in section, a substantially horizontal top wall, the said obtuse angle being between 1 degree and 60 degrees, and more particularly between 5 and 20 degrees.

According to a second aspect, the invention relates to a suspended-ceiling panel comprising a frame as explained above, and a sheet in which the frame is bagged, thus defining a strip of bottom stretched sheet and a strip of top stretched sheet.

According to a third aspect, the invention relates to a suspended ceiling comprising a panel as explained above, this panel being mounted on an inverted-T-shaped support.

Other subjects and advantages of the invention will appear in the course of the following description of embodiments, a description that will be made in the light of the appended drawings, in which.

Figure 1:
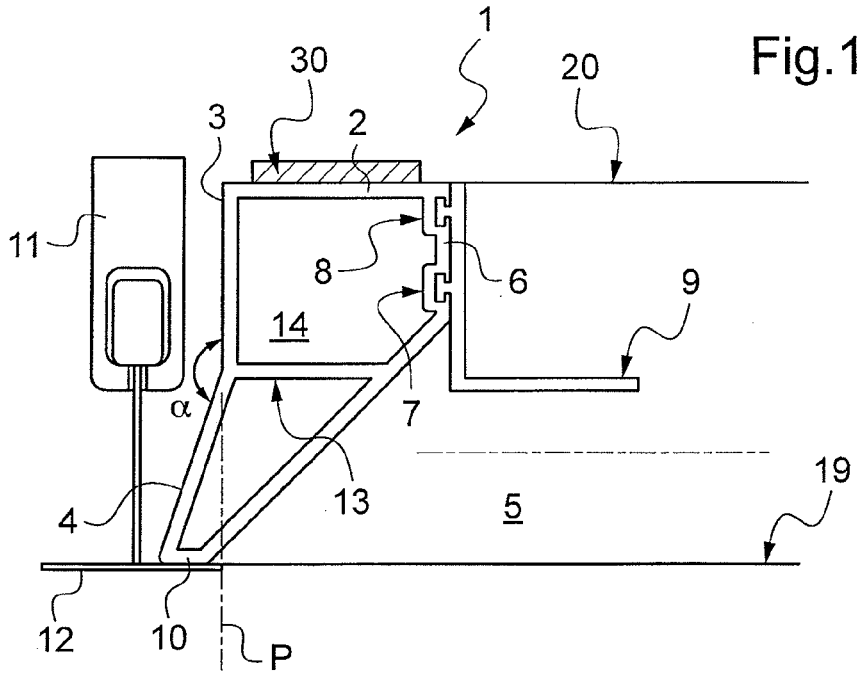
FIGS. 1 and 2 are views in section of panels comprising a frame, this frame being bagged in a sheet, an angle plate (being in place in the variant of FIG. 2.

The panel frame 1 shown in FIG. 1 is for example made of aluminium alloy by extrusion.

This frame 1 comprises a substantially horizontal top wall 2, a side wall comprising a substantially vertical top portion 3 and an inclined bottom portion 4.

The top portion 3 and the bottom portion 4 define an angle $\alpha$ (alpha) of the order of 10 to 20 degrees, this angle alpha being obtuse when measured on the outer face of the frame. In other words, the bottom portion 4 moves away from the inside 5 of the frame 1.

The frame also comprises an inner flange 6 that is substantially vertical and parallel to the top portion 3 of the side wall. Arranged on this inner flange 6 are two grooves 7, 8 with their opening turned towards the inside 5 of the frame 1. These grooves 7, 8 are optionally used for attaching a bearing angle bar 9 for an insert, like for example a sound and/or heat insulation insert, or else a lighting device.

The frame 1 also comprises a narrow horizontal bearing surface 10, on the bottom portion of the side wall. In the embodiments shown, the bottom portion 4 of the side wall, the angle alpha and the width of the horizontal bearing surface 10 are chosen so that this bearing surface 10 extends substantially completely to the outside of the frame, relative to a vertical plane P corresponding to the top portion 3 of the side wall.

This embodiment makes it possible to conform as well as possible to the shape of the supports 11 of inverted-T bars 12.

The frame 1 also comprises a first substantially horizontal stiffening wall 13. This first stiffening wall forms a box assembly 14 with the top wall 2, the top portion 3 of the side wall and the inner flange 6.

Figure 2:
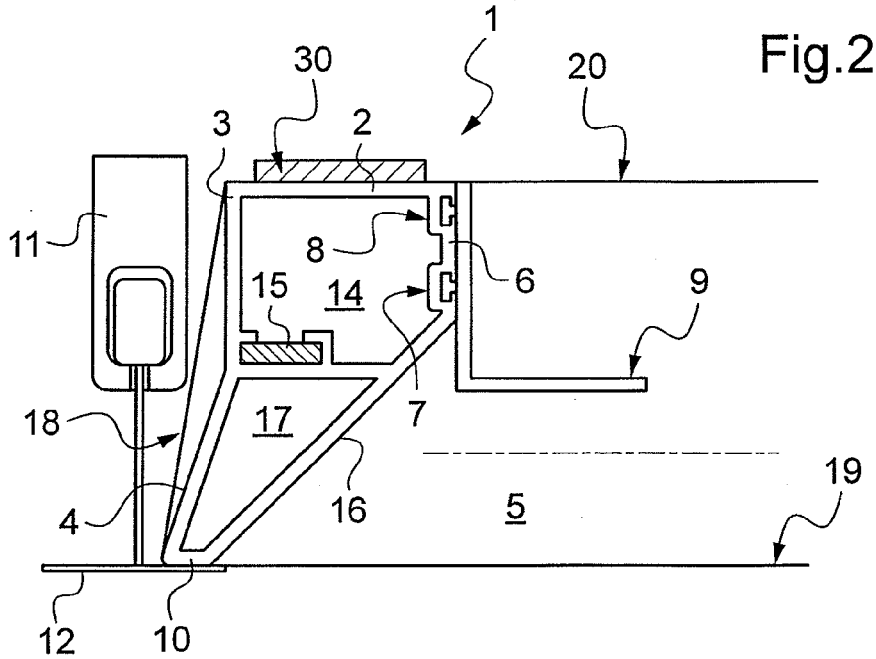

On this first stiffening wall, as can be seen in FIG. 2, a C-shaped groove can be placed to house a strap or bracket 15 for assembling two contiguous segments of frame.

The panel frame can include three C-shaped grooves extending in the box assembly 14. These three grooves extend over the top wall 2, the top portion 3 of the side wall and the first stiffening wall. Each of these grooves makes it possible to fit straps or brackets for assembling contiguous segments of frame.

The frame 1 also comprises a second stiffening wall 16 connecting the bearing surface 10 and the inner flange 6. This second stiffening wall forms a box assembly 17 with the side wall, the bearing surface 10 and the first stiffening wall 13.

The frame is bagged in a sheet 18, so as to define a bottom sheet strip 19 and a top sheet strip 20. For example, the sheet is advantageously heat-shrunk onto the frame.

In the embodiment shown, these two strips of sheet are substantially parallel. Between these two strips 19, 20 sound and/or heat inserts (not shown) can be mounted, on angled bars 9 or any other ad hoc support, mounted on the frame 1 via the grooves 7, 8. The presence of two grooves 7, 8 (or more) makes it possible to adjust the mounting height of the angle bars 9.

As an indication, the angle between the horizontal and the stiffening wall 16 is of the order of 40 degrees, the angle between the horizontal and the bottom portion 4 of the side wall is 70 degrees, the total height of the frame being 50 to 100 millimeters.

The materials used for the sheet are advantageously fire-resistant polymers that are sealed against the air and dust and humidity and are easy to maintain.

Translucent or opaque, coloured or not coloured in the mass, matt, lacquered, marbled, buckskin or satin-finished, these materials can therefore be used in both an industrial and a hospital environment, for collective equipment, for laboratories or for dwellings. The lacquered finish provides a mirror effect often used in commercial centres, a matt finish fairly similar to a plaster appearance being more usual in conventional decors.

The panel frame thus designed has a great resistance to deformation because of the presence of the obtuse angle $\alpha$ (alpha) and of the presence of stiffening walls forming box assemblies.

The applicant has however found that slight appearance defects can occur, in particular when the panels have a large surface area.

To solve this problem, once the frame 1 is pocketed, two flat sections 30 are fixed to the frame 1. More precisely, the flat sections are fixed to the top wall 2 of the frame 1.

The flat sections are advantageously narrower than the top wall 2. They are therefore not visible to an observer placed in front of the bottom face 19 of the sheet.

Figure 3:
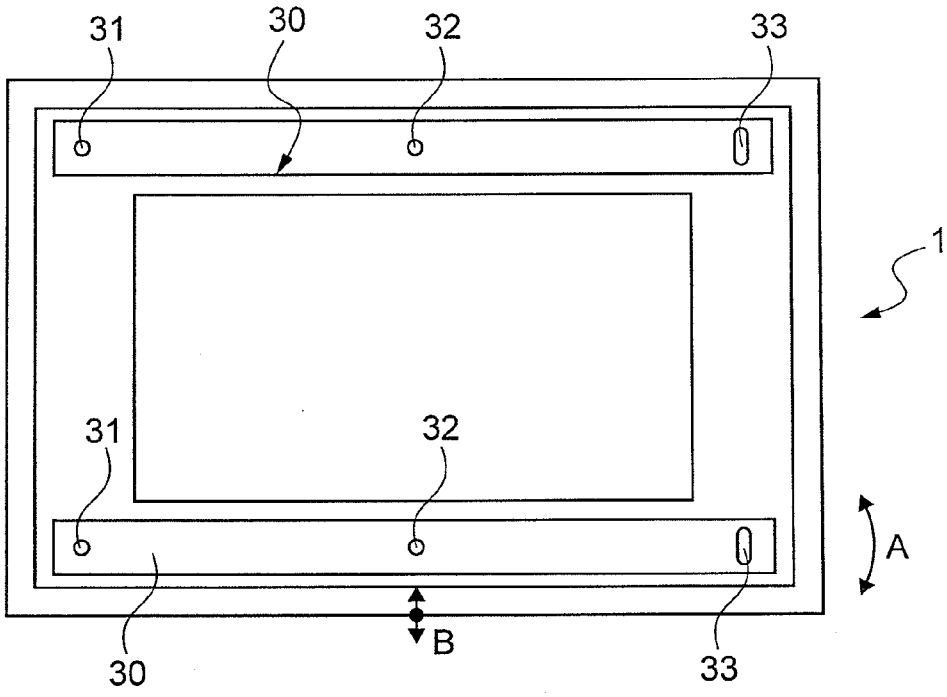
FIG. 3 is a top view of the panels shown in FIGS. 1 and 2.

In the embodiment shown in FIG. 3, the frame is substantially rectangular and the flat sections 30 are placed parallel to the long sides of the panel.

In another embodiment, the panel is substantially rectangular or else square, and is provided with more than two flat sections, for example four, each placed parallel to one side of the panel.

In another embodiment, the panel is substantially polygonal, and is provided with at least one flat section placed substantially parallel to one of its sides.

The flat sections 30 are metal in one embodiment. Advantageously, the flat sections 30 are made of aluminium alloy.

Each flat section is provided with three through-holes 31, 32, 33. These through-holes are substantially aligned.

Two of the three holes have a circular opening. A screw is inserted into each of these two circular holes, the screwing being completed without tightening.

The third hole 33 is slightly ovalized or even oblong. A screw is inserted through this third hole 33.

In the embodiment shown, the ovalized or oblong hole 33 is placed in a side portion of the flat section.

In other embodiments, the ovalized or oblong hole is placed in the central portion of the flat section, for example half-way.

In order to ensure a controlled bending of the frame (arrow B, FIG. 3), a stress is applied to the flat sections 30 (arrow A, FIG. 3). Then, the screw passing through the third oblong hole 33 is tightened.

The controlled bending makes it possible to re-establish the desired shape for the panel after it is pocketed, and this is done without inner reinforcements or reinforcing plates (for example made of Plexiglass®). The panel is therefore not made too heavy.

The adjustment can be carried out in production, or during installation on the work site. The installer can therefore ensure a perfect linearity of the edges of the rectangular or square panels.

The installation of the flat sections has no aesthetic impact on the panels, these flat sections, supported by the top wall 2, not being visible from beneath the panel.

Although the means for adjusting the bending have been described with reference to a profile for a frame to be pocketed as shown in document WO 2007051927, it is understood that these means may be put in place in any suspended-ceiling panel comprising a frame provided with a top wall 2.

The invention claimed is:

1. Panel frame for suspended ceiling, at least one side of this frame comprising, when seen in section, a top wall and a side wall, wherein the top wall is provided with a fitted flat section;

wherein the flat section is provided with three through-holes, these through-holes being substantially aligned, two of the three holes having a circular opening, the third hole being oval or oblong;

wherein a length of the flat section is longer than a width of the flat section and wherein the oval or oblong third hole extends in a direction transverse to a direction in which the length of the flat section extends.

2. Panel frame for suspended ceiling according to claim 1, this frame having a substantially rectangular, square, or polygonal contour and comprising at least two flat sections placed substantially parallel to one of the sides of the frame contour.

3. Panel frame for suspended ceiling according to claim 1, wherein the width of the flat section is substantially less than the width of the top wall.

4. Panel frame for suspended ceiling according to claim 1, wherein the side wall comprises a substantially vertical top portion and a bottom portion, the bottom portion and top portion defining an obtuse angle, on the outer face of the panel frame.

5. Panel frame according to claim 1, wherein at least one frame side comprises, when seen in section, in addition to the said top wall and side wall, at least one stiffening wall.

6. Panel frame according to claim 5, comprising a first stiffening wall, this first stiffening wall forming a box assembly with the top wall, the side wall and an inner flange.

7. Panel frame according to claim 5, comprising a second stiffening wall, this second wall forming a box assembly with the first stiffening wall and the side wall.

8. Panel frame according to claim 4, wherein the said frame side comprises, when seen in section, a substantially horizontal top wall, the said obtuse angle being between 1 degree and 60 degrees, and more particularly between 5 and 20 degrees.

9. Suspended-ceiling panel comprising a frame according to claim 1, and a sheet in which the frame is bagged, thus defining a strip of bottom stretched sheet and a strip of top stretched sheet.

10. Suspended ceiling comprising a panel according to claim 9, this panel being mounted on an inverted-T-shaped support.

11. The panel frame for suspended ceiling according to claim 1, wherein the at least one side of the frame, when seen in section, further comprises a bottom wall and an inside wall and wherein the top wall, the side wall, the bottom wall, and the inside wall form a channel or conduit.

* * * * *